United States Patent [19]

Freeman, Jr. et al.

[11] 4,021,910

[45] May 10, 1977

[54] METHOD FOR TREATING SUPERALLOY CASTINGS

[75] Inventors: William R. Freeman, Jr., North Muskegon; Louis E. Dardi, Muskegon, both of shall Islands

[73] Assignee: Howmet Turbine Components Corporation, Greenwich, Conn.

[22] Filed: Apr. 14, 1976

[21] Appl. No.: 676,857

Related U.S. Application Data

[63] Continuation-in-part of Ser. No. 485,496, July 3, 1974, abandoned.

[52] U.S. Cl. ..... 29/526.2; 29/526.3; 29/527.6; 29/530; 29/421 R; 29/DIG. 5; 29/DIG. 7; 29/DIG. 18; 29/DIG. 36; 164/66; 164/69; 164/76; 164/119; 148/131

[51] Int. Cl.[2] ..... B22D 11/126

[58] Field of Search ..... 164/120, 66, 119, 69; 148/131, 161; 29/471.5, 526.2, 412

[56] References Cited

UNITED STATES PATENTS

| | | | |
|---|---|---|---|
| 1,891,234 | 12/1932 | Langenberg | 148/131 X |
| 2,426,814 | 9/1947 | Burkhardt | 164/66 X |
| 3,279,005 | 10/1966 | Wehmeyer | 164/66 |
| 3,420,291 | 1/1969 | Chandley et al. | 164/120 X |
| 3,601,884 | 8/1971 | Kemeny | 29/471.5 |
| 3,732,128 | 5/1973 | Statham | 148/161 |
| 3,748,196 | 7/1973 | Kemeny | 29/526.2 |
| 3,758,347 | 9/1973 | Stalker | 148/131 |
| 3,866,301 | 2/1975 | Salsgiver | 29/412 |

FOREIGN PATENTS OR APPLICATIONS

| | | | |
|---|---|---|---|
| 738,757 | 10/1955 | United Kingdom | 164/66 |

*Primary Examiner*—C.W. Lanham
*Assistant Examiner*—V. K. Rising
*Attorney, Agent, or Firm*—McDougall, Hersh & Scott

[57] ABSTRACT

A method for treating investment cast superalloy castings wherein the portions of the castings which solidify directly against the mold walls comprise a substantially continuous or encapsulating skin of a metallic and/or nonmetallic composition. In such castings, defects in the form of material voids, including defects present immediately beneath the skin, are eliminated by the application of heat and pressure. The castings are heated to temperatures sufficient to achieve metal movement in the form of yield or creep, and a pressure of at least about 10,000 psi is applied by means of a surrounding gaseous atmosphere. The heat and pressure application deforms the material in the area of the voids and consolidates this material to substantially remove the voids and to thereby improve the performance characteristics of the castings. The encapsulating skin also serves as a protective coating during the hot isostatic pressing whereby contamination of the casting by elements such as oxygen or nitrogen in the furnace atmosphere is avoided, or drastically reduced. By eliminating surface defects and avoiding surface contamination, the investment castings are cast to substantially exact final dimensions since finishing operations are minimized.

8 Claims, 3 Drawing Figures

METHOD FOR TREATING SUPERALLOY CASTINGS

This application is a continuation-in-part of application Ser. No. 485,496, filed on July 3, 1974, now abandoned.

This invention is directed to an improved method for treating superalloy castings subsequent to the casting operation. The invention is particularly concerned with the treatment of castings which are formed by investment casting in ceramic molds, or under similar conditions.

In the production of superalloy castings, it is well-known that internal or externally connected material voids are relatively common. Specifically, defects occasioned by microshrinkage, gas entrapment, cavity shrinkage, as well as other defects resulting in internal and externally connected material voids are commonly encountered. All such voids adversely affect properties, and the internal voids naturally create particular problems. Since precision casting involves close dimensional tolerances, even the extenally connected defects are problematical since they cannot be cured by simply grinding away the objectionable areas.

Where castings are formed of highly expensive alloys, the presence of casting defects represents a particularly severe problem. Such castings cannot be used where the parts are employed for critical purposes, for example as jet engine turbine blades. Thus, it is known that the presence of internal and/or externally connected defects will cause part failure under the operating conditions of the parts and, accordingly, such parts must be rejected. The parts are then only useful as scrap, and this represents a great loss to producers in view of the high production costs involved in precision casting.

Various procedures have been developed for treating castings to eliminate the internal and externally connected defects. One such process known as hot isostatic pressing involves the simultaneous application of high temperature and pressure in a gaseous atmosphere, the combination of the temperature and pressure resulting in creep, yielding, or similar movement of material whereby voids can be eliminated or at least greatly reduced.

In the case of internal voids, the pressure differential is possible since the material surrounding the voids effectively seals the voids with respect to the high pressure gaseous atmosphere surrounding the article being treated. In the case of externally connected voids, however, equilibrium develops as the high pressure gas enters the voids in which case it becomes impossible to achieve the desired yielding or creep for closing up the voids.

Procedures have been developed for healing the external defects as described for example in Stalker U.S. Pat. No. 3,758,347. This procedure involves coating of external surfaces to seal off the material voids, and to thereby prevent the penetration of high pressure gas into the voids. Under such conditions, yield or creep can develop at high pressure and temperature whereby healing of the external voids is accomplished.

It has also been recognized that treatment of castings under hot isostatic conditions can lead to contamination of the castings even though substantially inert atmospheres such as argon are employed. Thus, such atmospheres contain amounts of contaminating elements such as oxygen and nitrogen, the latter being particularly prevalent and deleterious, and these elements will react with the casting surfaces necessitating subsequent cleaning operations designed for removing such reaction products. In cases of severe contamination, the parts become unusable.

It is a general object of this invention to provide an improved method for treating superalloy castings.

It is a more specific object of this invention to provide a method for treating superalloy castings which effectively eliminates the presence of detrimental externally connected voids in the castings and which, at the same time, provides for elimination of internal voids.

It is a further object of this invention to provide a method for treatment of superalloy castings which avoids surface contamination of the castings by elements present in atmospheres utilized for hot isostatic pressing of the castings.

These and other objects of this invention will appear hereinafter and for purposes of illustration but not of limitation, illustrations relating to the invention are shown in the accompanying drawings in which.

The subject matter of this invention generally comprises a method for treating superalloy castings which are subject to the formation of externally connected defects and which may be considered unsuitable for use without the elimination of the defects. The invention particularly relates to superalloy investment castings of the type formed in shell molds and the like, that is, castings which are considered precision castings and which are, therefore, relatively expensive. These castings uniquely are characterized by the problems referred to when compared with die and ingot castings, the invention not being applicable to these other castings.

In accordance with the procedure of the invention, superalloy castings are formed in ceramic molds at which time the portions of the castings which solidify directly against the mold wall constitute a substantially continuous skin. In discussing the continuous skin which comprises a critical consideration of this invention, it will be understood that a skin which substantially eliminates the penetration of gas from a surrounding atmosphere is intended.

Figure 1:
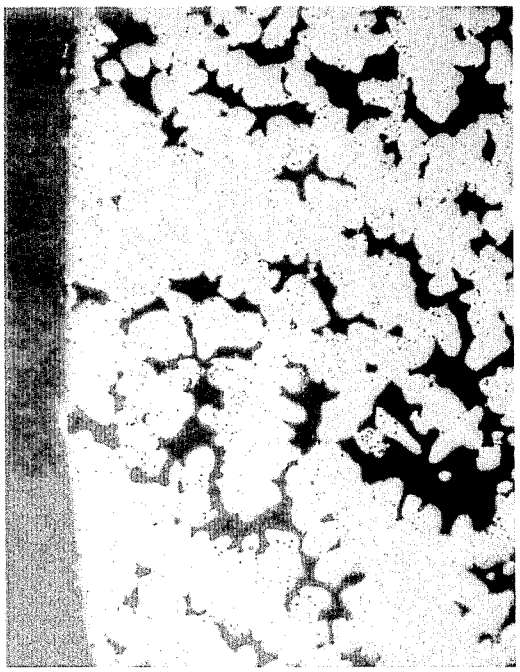
FIG. 1 is a photomicrograph illustrating the structure of a superalloy casting.
Figure 2:
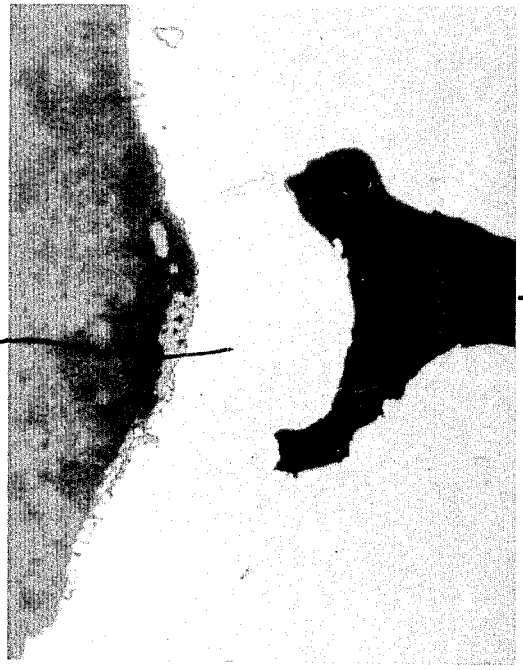
FIG. 2 is an enlarged photomicrograph of a section of the casting shown in FIG. 1; and, FIG. 3 is a photomicrograph illustrating the structure of a superalloy casting after surface finishing in accordance with standard practice.

FIGS. 1 and 2 comprise illustrations by way of photomicrographs of the condition of castings adapted to be utilized in the practice of the invention. FIG. 1 is a 50 times magnification illustrating a portion of the cross section of a superalloy casting. The casting was sectioned and photographed after separation from a shell mold but without any surface cleaning or other surface treatment taking place. As shown in FIG. 1, a plurality of voids (black areas) are formed in the casting and some voids are quite close to the surface of the casting. It is noted, however, that in all instances, a barrier of material (white areas) is present so that none of the voids are exposed to the exterior of the casting.

FIG. 2 is a 500 times magnification of a portion of the microstructure shown in FIG. 1. In particular, the illustration of FIG. 2 illustrates the void 10 and the metal barrier 12 showing that the void is completely closed off from the atmosphere, and a skin which substantially eliminates the penetration of gas is, therefore, provided.

Figure 3:
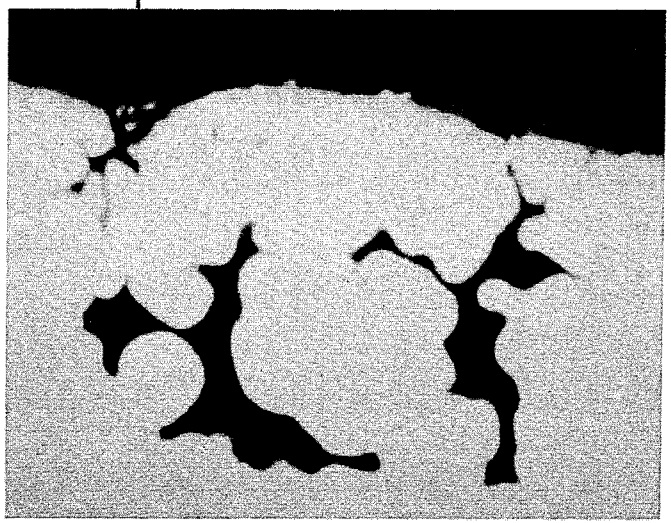

This skin comprising the particular barrier 12 has a thickness in the order of 0.0015 inches. As noted, and as will be more fully discussed, this barrier must be preserved to achieve the advantages of the invention. It has been found that conventional finishing operations will remove as much as 0.002 inches of metal in which case the void 10 would be exposed whereby the hot isostatic pressing will not eliminate this void. FIG. 3 indicates the results of finishing operations whereby surface connection was realized, and localized nondensification resulted. Reference is made in particular to the area designated by the numeral 14 wherein exposure of a void extending into the casting is apparent. Thus, the surface finishing obviously resulted in the removal of the barrier material which, even though extremely thin, is essential for purposes of eliminating voids such as those shown at 14.

The material voids, including voids immediately beneath the surface skin, may be the result of gases which are present in the course of the casting operation or due to shrinkage caused by volumetric changes during the solidification process. Unless these voids or defects are removed, serious limitations on the properties of articles produced from the castings are imposed.

This invention provides for the simultaneous application of heat and pressure to castings which are unfinished, that is, castings characterized by the continuous skin. The heating is preferably in the range from 50° F below the gamma prime solvus temperature up to the solidus temperature for the superalloy being treated. The pressure application should be at least about 10,000 psi with maximum pressures being dependent primarily upon equipment limitations and being upwards of 50,000psi. Pressures between 15,000 and 30,000 psi provide satisfactory conditions in virtually all instances. Generally, increased time and/or pressure are required as lower temperatures are employed.

The process of the invention is more particularly characterized by the utilization of the sound skin of material which solidifies directly against the mold wall. This skin is maintained after casting by eliminating conventional finishing operations such as blasting or belting. The shell mold or other mold structure may be subjected to a gentle knock-out operation, but areas of the mold may remain on the parts during the subsequent processing. It is particularly contemplated that the entire part cluster be subjected to the hot isostatic treatment with the mold in place where this represents a convenient manufacturing procedure. Thus, the mold porosity permits gas penetration for purposes of applying the desired pressure to the sound, continuous exterior of the castings. Equipment space limitations represent the greatest drawback of this procedure.

Gate and runner portions, if completely removed as in normal finishing operations, may expose surface connected defects. For this reason, the presence of at least a portion of the gate and runner portions is particularly desirable. These cast portions will, along with the aforementioned skin, provide sound regions of material for sealing the casting surfaces. Under these circumstances, the application of the gas pressure will result in closing of porosity beneath these surfaces since the gas will not penetrate to equalize the pressure in the area of the material voids. Subsequent removal of the residual gates and runners will eliminate surface connected porous material from the end product.

In addition to providing the sealing function, the continuous skin recognized by this invention serves as a means for preventing surface contamination of the castings. The skin is comprised of a metallic and a nonmetallic layer — the latter an adherent oxide film which is protective in nature and inhibits rate of reaction. Argon or like atmospheres employed for hot isostatic pressing contain some amounts of oxygen, nitrogen, and other potentially damaging materials. The continuous skin serves as a barrier against the formation of reaction products of such materials on the ultimate article surfaces.

In addition to the presence of mold material and superfluous cast portions, any cores present in the castings may be maintained during the hot isostatic pressing. It has been found that properly selected core materials are not in any way detrimental to the processing and that the properties of the superalloys are not adversely affected by the presence of the core material during the processing. The core removal can be conveniently carried out during any subsequent finishing operations, and the core material may itself assist in sealing during the processing and will assist in preventing oxidation of the casting surfaces defining the passages, and will aid in preventing any collapse of small passages. It is also contemplated that a plating or other sealing material could be employed for closing off the core passages in which case the core material therein acts as a pressure applying media relative to the passage surfaces for insuring healing of surface connected defects.

A demonstration of the advantages of the invention was obtained upon casting turbine blades of the following superalloy compositions:

| | Cr | Mo | Ta | W | Cb | Co | Ti | Al | Hf | C | B | Zr | Ni |
|---|---|---|---|---|---|---|---|---|---|---|---|---|---|
| Alloy A | 8 | 6 | 4.3 | — | — | 10 | 1 | 6 | 1.1 | 0.11 | 0.015 | 0.13 | Bal. |
| Alloy B | 12.5 | 2 | 4 | 4 | — | 9 | 4 | 3.5 | 1 | 0.16 | 0.015 | 0.10 | Bal. |
| Alloy C | 9.5 | 3 | — | — | (1V) | 15 | 4.2 | 5.5 | — | 0.17 | 0.015 | 0.06 | Bal. |
| Alloy D | 9 | — | 2.5 | 10 | — | 10 | 1.5 | 5.5 | 1.5 | 0.15 | 0.015 | 0.05 | Bal. |
| Alloy E | 19 | 3 | — | — | 5 | — | 1 | 0.5 | — | 0.05 | — | — | Bal. |
| Alloy F | 9 | 2 | 3.8 | 7 | — | 10 | 4 | 4.3 | — | 0.17 | 0.015 | 0.07 | Bal. |
| Alloy G | 27 | 5 | — | — | — | Bal. | — | — | — | 0.25 | — | — | 3 |
| Alloy H | 23 | — | 3.5 | 7 | — | Bal. | 0.25 | — | — | 0.6 | — | 0.07 | 10 |

For testing purposes, blades formed from Alloy A were prepared, and these blades were of a relatively difficult to cast design including five cooling passages requiring the use of cores. The blades have been found to be particularly subject to the presence of porosity in the as-cast condition, and are subject to a high reject rate.

In one instance, 150 blades were cast, and these were of a design known to have substantial porosity in the as-cast condition. 32 of the blades were then subjected to surface treatment by grit blasting. The ceramic cores were removed, and the castings were then subjected to hot isostatic pressing comprising exposure of the castings to a temperature of 2200° F (±25° F). The specimens were heated in a pressure chamber for two hours while a pressure of 14,500 psi (±500 psi) was maintained in the chamber. Argon gas was utilized for all tests referred to in this application.

The hot isostatic pressing resulted in improved integrity; however, all 32 blades exhibited varying amounts of porosity in critical near-surface regions as a result of surface connected porosity resulting from the grit blasting operation. Concurrently, porosity was eliminated from areas free of surface connection.

118 blades were subjected to the same hot isostatic pressing without any prior surface treatment in accordance with this invention. After casting, the majority of the ceramic mold portions were gently removed from the castings; however, all castings retained some portions of ceramic, there was extensive gate evidence in each instance, and the cores utilized for forming the internal passages remained in place.

Examination of these castings revealed that 116 of the 118 parts had no detectable porosity, and could be termed completely healed. The remaining two castings exhibited some porosity in pedestal regions. The presence during processing of the ceramic cores, gate portions, and mold portions in no way affected the characteristics of the blade structure when subsequent finishing operations were performed to remove these materials.

In addition to the examination of the microstructure of the castings, tests were performed for purposes of evaluating the properties of the blade. In a first series of tests comprising 1400° F/94 KSI rupture life tests, the castings subjected to the hot isostatic pressing in the as-cast condition showed a substantially improved rupture life in the order of a two to three-fold increase. Improvements in rupture elongation in the order of 30 percent were also noted.

Rupture life tests at 1800° F/29 KSI showed a 50 percent improvement in some instances while rupture elongation was improved by about 20 percent.

The improvements in rupture life and elongation are accompanied by improved thermal and mechanical fatigue properties. It is concluded that the performance characteristics of the difficult to cast cored blades as well as the rejection rate of the blades can be materially improved on a production basis.

After completion of cleaning operations, inspection of the surfaces of the articles treated in accordance with this invention revealed that the surfaces were extremely clean with the absence of any reaction products resulting from oxygen or nitrogen present in the atmosphere employed during hot isostatic pressing. This was in contrast to the surface condition of the 32 blades which were subjected to grit blasting prior to hot isostatic pressing. These blades revealed surface contamination including oxidation or nitridation, subsequent to hot isostatic pressing whereby a second cleaning operation was required. Nitridation contamination was proven to be particularly difficult to eliminate, requiring special procedures.

Although the foregoing discussion has primarily referred to turbine blades, it will be appreciated that various investment castings, superalloy parts, including turbine vanes, wheels and other structural components can be readily subjected to the described processes with high beneficial results. In the production of turbine wheels formed of Alloy B, the cast parts were obtained in the unfinished condition. When subjected to hot isostatic pressing, the parts exhibited significantly improved low cycle fatigue properties when tested at 900° F. This represents an extremely important improvement in view of the fact that the useful life of such parts operating under such conditions has been a significant problem limiting their wider application. In testing the same and similar parts, significant room temperature property increases were also observed whereby the applicability of the invention to superalloy parts employed at room temperature or at relatively low temperatures is recognized. In this connection, the subjecting of the parts to hot isostatic pressing has been found to improve the machinability of the parts which is a feature having value irrespective of the operating conditions of the parts.

The particular conditions for treatment of superalloy parts will vary with material composition and are also dependent upon processing equipment limitations. It has been found, for example, that with commercially available, large diameter hot isostatic pressing units, a maximum of about 15,000 psi operating pressure is now available. Under such conditions, maximum improvements in properties for the blades tested were available when heating within the aforementioned preferred range, for example, at 2200° F ±25° F. Other experiments indicate that where pressures in the order of 30,000 psi could be obtained, processing in the order of 2150° F ±25° F provided improved results. Higher pressure will permit the use of correspondingly lower temperatures. In all instances, a treating time of about 2 hours was employed; however, the treatment time may vary from about 10 minutes to about 10 hours and preferably is maintained for from 2 to 4 hours.

In the course of treating parts in accordance with this invention, an inert atmosphere may be employed to avoid surface contamination. On the other hand, it is contemplated that the parts may be enclosed within a container and the pressure of the atmosphere will then be applied to the container in which event the parts themselves will not be subjected to any contaminants in the atmosphere. A suitable filler material may be placed within the container whereby the pressure of the atmosphere will be applied to the parts after being transmitted through the container and the filler material.

It will be apparent that the basic feature of this invention involves the treatment of the castings in an unfinished state whereby the continuous skin necessary for curing defects close to the surface will be preserved. It is contemplated that various steps may be taken for purposes of accentuating the formation of the continuous skin to thereby completely insure the improved results of the invention. This may be accomplished by utilizing nucleants in the surface portion of the mold which is first contacted by the molten metal. The presence of cobalt oxide, cobalt aluminate and/or other nucleants will tend to promote rapid nucleation and freezing of the casting surface whereby subsequent freezing will take place behind a continuous skin which is initially formed.

It is also contemplated that mold preheat can be utilized as a means for accentuating the formation of the continuous skin. Specifically, by maintaining a lower than normal mold temperature, more rapid freezing will occur in the surface areas of the casting whereby a continuous barrier can be formed without shrinkage voids or the like developing near the surface.

Contrary to normal practice as shrinkage tends to segregate dramatically in last area to freeze — more unacceptable than if dispersed throughout part.

The procedures of this invention will provide savings in terms of a reduction in the number of reject castings since the internal porosity problems can be effectively minimized in accordance with the practice of the invention. It is also contemplated that utilization of extra gates which are often employed for purposes of reducing porosity in areas which are otherwise difficult to cast can be avoided. Thus, even if such porosity occurs, the presence of the continuous skin and the application of the hot isostatic pressing will provide for substantial elimination of the porosity.

Although the hot isostatic pressing is recognized as contributing to the improved physical properties of the castings, it is believed that the presence of the aforementioned sound skin regions also contributes to improved properties so that these improvements result from a combination of the hot isostatic treatment and the fact that this treatment is carried out in the as-cast condition. The improved properties are believed to result from the uniquely sound character of the skin which develops in the casting of the superalloys.

It is preferred that the as-cast dimensions be as close as possible to final dimensions so that there is a minimum requirement for machining or other surface finishing. As previously noted, conventional finishing operations will remove in the order of 0.002 inches of metal from a cast surface, and prior operations have allowed for a finishing operation subsequent to casting and a second finishing operation subsequent to hot isostatic pressing whereby metal removal in the order of .004 inches was involved. With this invention, the first finishing operation is completely avoided with only a subsequent operation being necessary. For this reason, the as-cast dimensions of the castings are significantly closer to the desired final dimensions. Superalloy turbine vanes and blades are conventionally characterized by specific dimensions which generally must be maintained with tolerances within about ±0.006 inches per inch. With the procedures of this invention, the castings are produced in molds which can be dimensioned no greater than 0.002 inches above the maximum tolerable dimensions for a part so that a single finishing operation will bring the parts within a permissible range.

The system of the invention also, of course, provides advantages to the extent that the system permits the elimination of any coating such as described in the aforementioned Stalker U.S. Pat. No. 3,758,347. Such coatings inherently develop problem areas since the presence of any material which is chemically foreign to the casting itself can create problems from the standpoint of part performance. For example, even minor alloying or the presence of minor amounts of foreign material could create an area making the castings more susceptible to fatigue failure. It is also clear that the necessity for coating requires several additional handling steps including cleaning operations over and above the coating operations whereby the possibility of damage and contamination is multiplied.

The recognition of the sound continuous coating in superalloy castings has, as indicated above, provided substantial and highly significant improvements in the casting properties whereby the performance of the castings, particularly at elevated temperatures, is materially improved. The presence of the continuous skin which enables the hot isostatic processing is apparently unique to superalloys insofar as current investigations are concerned. The ability to cure the internal defects which is allowed by the presence of the skin also is of most importance in the case of superalloys in view of the high performance demands placed on such alloys.

It will be understood that various changes and modifications may be made in the above described structure which provide the characteristics of the invention without departing from the spirit thereof particularly as defined in the following claims.

That which is claimed is:

1. In a method for the production of a superalloy part which is characterized by specific nominal dimensions and which must be produced with close tolerances, the improvement comprising the steps of preparing an investment casting mold defining a cavity dimensioned to minimize the need for machining to final dimensions, including nucleating agents in the molten metal engaging surfaces of the mold to promote rapid nucleation and freezing of said metal, pouring molten metal of said superalloy composition into said mold, and solidifying the molten metal in said mold, the solidified casting portions adjacent said molten metal engaging surfaces comprising a sound, substantially continuous skin, and wherein defects in the form of material voids are located immediately beneath the skin, locating the casting in a chamber subsequent to complete solidification thereof and without any surface finishing operations whereby said skin remains intact, introducing a surrounding gaseous atmosphere into the chamber, applying pressure to the casting through the atmosphere between about 10,000 psi and 50,000 psi, heating the casting to an elevated temperature, said skin being of sufficient thickness to substantially prevent the penetration of said gas into said voids, said casting being at said temperature for a period of time during application of said pressure sufficient to permit metal movement in the casting when the casting is subjected to said pressure, the combination of heat, pressure and time serving to achieve said metal movement and to substantially eliminate said voids by deforming and consolidating the material in the area of said voids, and thereafter subjecting said casting to a finishing operation which removes only the nonmetallic components on the part surfaces including mold material, any superfluous gate and runner portions, and only that additional amount of metallic material necessary to assure complete removal of said nonmetallic components.

2. A method in accordance with claim 1 wherein said pressure application takes place at least partly when said castings are at a temperature in a range from 50° below the gamma prime solvus temperature of the castng up to the slidus temperature of the casting.

3. A method in accordance with claim 1 wherein said pressure is about 25,000 psi.

4. A method in accordance with claim 1 wherein said casting is separated from the mold by a gentle knockout operation prior to the heat and pressure application.

5. A method in accordance with claim 1 wherein said casting is formed in gas permeable molds, said skin solidifying directly against the mold surface, and wherein the heat and pressure application is accomplished with the mold in place around the casting.

6. A method in accordance with claim 5 wherein a cluster of castings are solidified within the mold.

7. A method in accordance with claim 1 wherein said casting solidifies with gate and runner portions, said heat and pressure application occurring prior to removal of said portions.

8. A method in accordance with claim 1 wherein said casting defines internal passages with cores located within the passages, and wherein said heat and pressure application occurs prior to removal of said cores.

* * * * *

REEXAMINATION CERTIFICATE (215th)

United States Patent [19] [11] B1 4,021,910

Freeman, Jr. et al. [45] Certificate Issued Jul. 10, 1984

[54] METHOD FOR TREATING SUPERALLOY CASTINGS

[75] Inventors: William R. Freeman, Jr., North Muskegon; Louis E. Dardi, Muskegon, both of Mich.

[73] Assignee: Howmet Turbine Components Corportion, Greenwich, Conn.

Reexamination Request:
No. 90/000,353, Apr. 5, 1983

Reexamination Certificate for:

| | |
|---|---|
| Patent No.: | **4,021,910** |
| Issued: | **May 10, 1977** |
| Appl. No.: | **676,857** |
| Filed: | **Apr. 14, 1976** |

Related U.S. Application Data

[63] Continuation-in-part of Ser. No. 485,496, Jul. 3, 1974, abandoned.

[51] Int. Cl.[3] ..... B22D 11/128

[52] U.S. Cl. ..... 29/526.2; 29/421 R; 29/526.3; 29/527.6; 29/530; 29/DIG. 5; 29/DIG. 7; 29/DIG. 18; 29/DIG. 36; 148/131; 164/66.1; 164/119

[56] References Cited

U.S. PATENT DOCUMENTS

| | | |
|---|---|---|
| 3,019,497 | 2/1962 | Horton et al. . |
| 3,116,523 | 1/1954 | Royal . |
| 3,157,926 | 11/1964 | Horton et al. . |
| 3,259,948 | 7/1966 | Feagin . |
| 3,411,078 | 4/1969 | Chandley . |
| 3,420,291 | 1/1969 | Chandley et al. . |
| 3,496,624 | 2/1970 | Kerr et al. . |
| 3,562,371 | 2/1971 | Bush . |
| 3,643,728 | 2/1972 | Hulse . |
| 3,695,856 | 9/1971 | Bareland et al. . |
| 3,732,128 | 5/1973 | Statham . |
| 3,758,347 | 9/1973 | Stalker . |

OTHER PUBLICATIONS

Ruddle, R. W.; Cibula, A., "The Metallurgical Principles of the Control of Non-Ferrous Castings", *Metallurgical Aspects of the Control of Quality in Non-Ferrous Castings*, London, 1957, May 1, 1957.

Flemings, M. C.; Barone, R. V.; Uram, S. Z.; and Taylor, H. F., "Solidification of Steel Castings and Ingots", *Transactions of the A.F.S.*, vol. 69, May 8-12, 1961.

Hodge, E. S.; Boyer, C. B.; Orcutt, F. D., "Gas Pressure Bonding", *Industrial and Engineering Chemistry*, vol. 54, No. 1, Jan. 1962.

Wilcox, R. J.; Martini, R. W., "Investment Castings for Advanced Aircraft", *Metal Progress*, vol. 82, No. 3, Sep. 1962.

Rapport, D. B., "Aerofoil Investment Castings for the Mach-3 Engine", *Foundry Trade Journal*, vol. 116, No. 2461, Feb. 6, 1964.

*Precision Metal Molding*, vol. 22, No. 12, Dec. 1964.

Hodge, E. S., "Elevated-Temperature Compaction of Metals and Ceramics by Gas Pressure", *Powder Metallurgy*, vol. 7, No. 14, 1964.

Bower, T. F.; Flemings, M. C., "Formation of the Chill Zone in Ingot Solidification", *Transactions of A.I.M.E.* vol. 239, Feb. 1967.

Naro, R. F.; Wallace, J. F., "Effect of Mold-Steel Interface Reactions of Casting Surface and Properties", *Transactions A.F.S.*, vol. 75, 1968.

Campbell, J., "On the Origin of Porosity in Long Freezing-range Alloys", *The British Foundryman*, vol. 62, Apr. 1969.

Campbell, J.; "The Nonequilibrium Freezing Range and its Relation to Hydrostatic Tension and Pore Formation in Solidifying Binary Alloys", *Trans. A.I.M.E.*, vol. 245, No. 9, Sep. 1969.

Pursall, F. W., "Mould-and Core-coatings for Iron Foundries", *Foundry Trade Journal*, vol. 127, No. 2764, Nov. 27, 1969.

*Metals Handbook*, 8th edition, vol. 5, Forging and Casting, A.S.M., 1970.

Whately, H. N., "Leachable Ceramic Cores", Society of Mechanical Engineers, tech. report, EM71-241, 1971.

Kahles, J. F.; Field, M., "Surface Integrity Guidelines for Machining-1971", Society of Manufacturing Engineers, tech. Report, IQ71-240, 1971.

(List continued on next page.)

*Primary Examiner*—Fred A. Silverberg
*Attorney, Agent, or Firm*—James P. Ryther; Emily A. Richeson

[57] ABSTRACT

A method for treating investment cast superalloy castings wherein the portions of the castings which solidify directly against the mold walls comprise a substantially continuous or encapsulating skin of a metallic and/or nonmetallic composition. In such castings, defects in the form of material voids, including defects present immediately beneath the skin, are eliminated by the application of heat and pressure. The castings are heated to temperatures sufficient to achieve metal movement in the form of yield or creep, and a pressure of at least about 10,000 psi is applied by means of a surrounding gaseous atmosphere. The heat and pressure application deforms the material in the area of the voids and consolidates this material to substantially remove the voids and to thereby improve the performance characteristics of the castings. The encapsulating skin also serves as a protective coating during the hot isostatic pressing whereby contamination of the casting by elements such as oxygen or nitrogen in the furnace atmosphere is avoided, or drastically reduced. By eliminating surface defects and avoiding surface contamination, the investment castings are cast to substantially exact final dimensions since finishing operations are minimized.

Basaran, M., "The Effects of Homogenization Treatment on Microporosity in Cast Steel", thesis, Massachusetts Institute of Technology, Jun. 1971.
Hebeisen, M. C. et al., "Vacuum Melting and Casting of Superalloys", N.A.S.A. report, NASA SP-5095, 1971.
Hallerberg, W. L., "Superalloy Investment Castings--Processing and Applications", CM71-160 Society of Manufacturing Engineers, 1971.
"Cleaning of Aircraft Quality Investment Castings", *Precision Metal*, vol. 30, No. 40, Jun. 1972.
Burke, J. J.; Weiss, V. eds., *Powder Metallurgy for High Performance Applications*, 1972.
Burke, J.; Flemings, M. C.; Gorum, A. E., eds., *Solidification Technology*, 1972.
Felker, T. S.; Clark, L. P.; Johnson, H. H., "Process for High-Integrity Castings", tech. report AFML TR-74-152, Dec. 1972 (Jul. 1974).
Sins, T. C.; Hagel, W. C., eds., *The Superalloys*, 1972.
Davies, G. J.; *Solidification and Castings*, 1972.
Wasielewski, G. E.; Lindblad, N. R., "Elimination of Casting Defects Using HIP", *Superalloys-Processing of the Second International Conference*, Sep. 18-20, 1972, MCIC-72-10.
Basaran, M.; Kattamis, T. Z.; Mehrabian, R.; Flemings M. C., "The Effect of Homogenization Treatment and Hot Isostatic Pressing on Microporosity in Cast Steel" *Metallurgical Trans.* vol. 4, No. 9, 1973.
Hanes, H. D., "Hot Isostatic Processing Reaches Maturity", SAMPE Quarterly, vol. 5, No. 2, Jan. 1974.
Kenton, D. J., "HIP-Nemisis of Shrinkage in Investment Castings", *Diesel & Gas Turbine Progress*, p. 36, Mar. 1976.

REEXAMINATION CERTIFICATE ISSUED UNDER 35 U.S.C. 307.

NO AMENDMENTS HAVE BEEN MADE TO THE PATENT.

AS A RESULT OF REEXAMINATION, IT HAS BEEN DETERMINED THAT:

The patentability of claims 1–8 is confirmed.

* * * * *